United States Patent [19]

Little

[11] 3,962,835

[45] June 15, 1976

[54] BUILDING UNIT

[76] Inventor: Philip Andrew Little, 235 Brunswick St., Fortitude Valley, 4004 Australia

[22] Filed: July 25, 1974

[21] Appl. No.: 491,858

[30] Foreign Application Priority Data

July 25, 1973 Australia ..... 4229/73
May 8, 1974 Australia ..... 7502/74

[52] U.S. Cl. ..... 52/73; 52/79; 52/220; 52/236

[51] Int. Cl.[2] ..... E04B 1/34; E04B 1/348

[58] Field of Search ..... 52/73, 79, 236, 220

[56] References Cited

UNITED STATES PATENTS

| | | | |
|---|---|---|---|
| 2,963,121 | 12/1960 | Felver | 52/73 |
| 3,468,081 | 9/1969 | Saarinen | 52/79 |
| 3,514,910 | 6/1970 | Comm | 52/79 |
| 3,526,067 | 9/1970 | Furter | 52/79 |
| 3,841,206 | 10/1974 | Meckler | 52/220 |

FOREIGN PATENTS OR APPLICATIONS

| | | | |
|---|---|---|---|
| 1,230,349 | 9/1960 | France | 52/236 |
| 1,500,966 | 10/1967 | France | 52/79 |
| 1,518,637 | 2/1968 | France | 52/79 |
| 389,864 | 7/1965 | Switzerland | 52/220 |

*Primary Examiner*—Ernest R. Purser
*Assistant Examiner*—Henry Raduazo
*Attorney, Agent, or Firm*—Donald D. Jeffery

[57] ABSTRACT

A pre-fabricated unit, usable singly or with others in constructing a building, has a roof section and a floor section interconnected by central end columns, the roof and floor sections both being rectangular, each being formed with transverse beams across its ends and longitudinal corrugations between the beams. When two units are superimposed, the floor section beams of the upper one bear on the roof section beams of the lower, the corrugations of the two sections interfitting with some clearance and forming longitudinal roof and floor ducts for service lines and conduits which communicate with transverse ducts formed between the beams and corrugations of the roof section.

3 Claims, 8 Drawing Figures

BUILDING UNIT

BACKGROUND OF THE INVENTION

The present invention relates to a pre-fabricated building unit which may be used singly, with wall cladding and other associated parts, but is more commonly used in association with other similar units, to constitute the main part of a building such as a house, block of apartments, school, hospital or the like. Many forms of pre-fabricated units of this general type have been made, but have been fairly expensive to manufacture and difficult to transport because of their weight and bulk. Also, they have not generally lent themselves to much flexibility of design, their structural features often greatly limiting the variations in external appearance and interior arrangement of buildings assembled with such units. The provision of adequate ducting for service lines and conduits has also presented a difficulty in many such units hitherto made.

BRIEF SUMMARY OF THE INVENTION

A pre-fabricated building unit according to the present invention may be simply and economically manufactured of reinforced concrete, lending itself to lightweight but very strong construction, and incorporating an extensive ducting system, its structure being such as to permit very great flexibility in the design of buildings assembled from such units. The unit comprises a roof section and a floor section, both of rectangular shape in plan view, rigidly interconnected in spaced parallel relationship by supporting columns. The roof section is formed with transverse beams at its ends, and between these beams the roof section is shaped to corrugated form, with upwardly extending hollow longitudinal ribs defining, between them, longitudinal channels. The floor section is also formed with transverse beams at its ends, and with a corrugated portion between these beams, with downwardly extending channels. The supporting columns preferably interconnect the central parts of corresponding beams of the roof and floor sections, and the parts are so made and arranged that when the unit is superimposed on a similar unit, the floor section beams of the upper one bear upon the roof section beams of the lower one, the floor section channels of the upper unit extending into the roof section channels of the lower unit. The interiors of the hollow ribs of the roof section constitute roof ducts for service lines and conduits, and communicate, at their ends, with transverse ducts which are formed between the roof section beams and these ribs. The floor section channels constitute floor ducts, which may also communicate with the transverse ducts when units are superimposed. The transverse ducts also communicate with vertical passages through the roof section beams, with which are aligned further vertical passages through the floor section beams, and these vertical passages may also carry service lines and conduits, so that an assembly of the units will be very extensively ducted. Provision is made for firmly interconnecting units in superimposed, adjacent and end-to-end arrangement.

BRIEF DESCRIPTION OF THE DRAWINGS

In order that the invention may be readily understood and carried into practical effect, reference is now made to the accompanying drawings, wherein.

DETAILED DESCRIPTION

Figure 3:
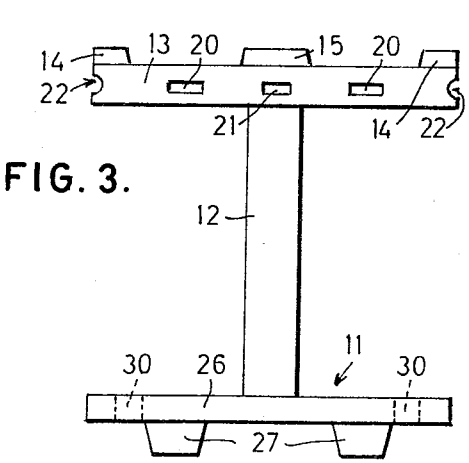
FIG. 3 is an end elevation of the unit.
Figure 4:
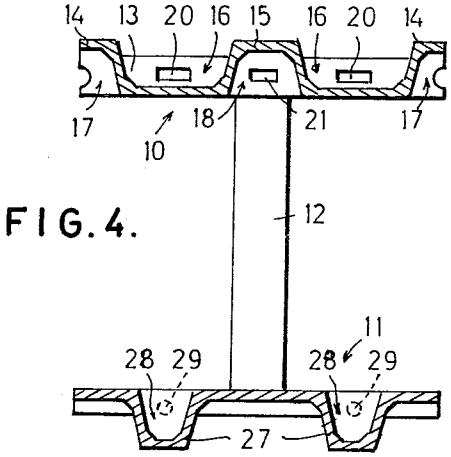
FIG. 4 is a cross-sectional view of the unit.
Figure 1:
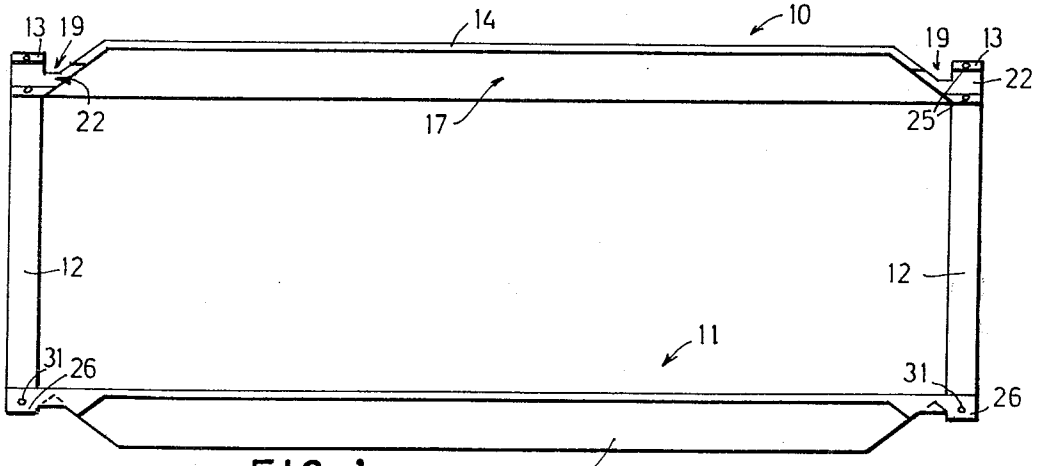
FIG. 1 is a side elevation of a building unit according to the invention.
Figure 2:
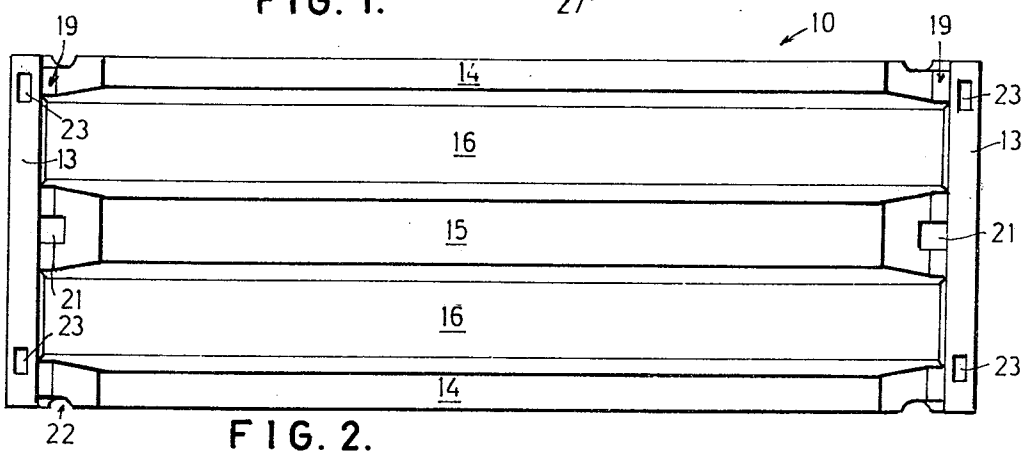
FIG. 2 is a plan view of the unit.

Referring initially to FIGS. 1 to 7 of the drawings, each of the units includes a roof section 10, a floor section 11 and two similar columns 12, all of these parts being preferably separately cast of reinforced concrete.

The roof section 10 is formed at each end with a transverse beam 13. Between the beams the roof section is of corrugated form, with two upwardly extending hollow side ribs 14 open at their outer sides and an upwardly extending hollow central rib 15, these ribs defining, between them, two longitudinal channels 16. The interior of each side rib 14 is a half roof duct 17, that of the central rib 15 is a roof duct 18. The undersurfaces of the channelled parts are co-planar with the undersurfaces of the beams 13. The top surfaces of the ribs 14 and 15 are co-planar, and above the level of the tops of the beams 13. The oblique ends of the ribs 14 and 15 are such that there is formed between them and the beams 13, two transverse channels or ducts 19.

Two passages 20 are formed horizontally through each beam 13 to lead into the end of the channels 16. A central passage 21 is formed horizontally through each beam 13 and also through the near end of the central hollow rib 15 to communicate with the roof duct 18 within this rib, and also with a transverse channel or duct 19.

At each end of each beam 13 there is formed a recess 22 of semi-circular cross-section, this recess being continued also through the near end of a side rib 14. A vertical passage 23 is formed through each end portion of each beam 13.

Figure 7:
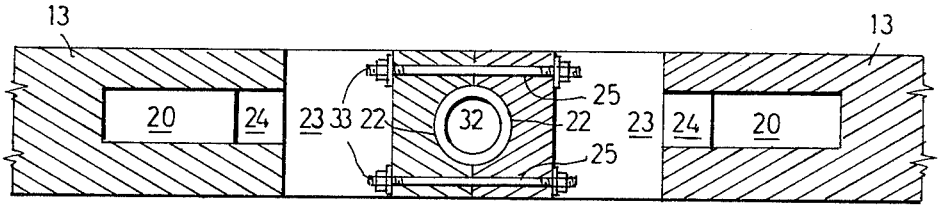
FIG. 7 is a detail section view showing an interconnection of two adjacent units.

As shown in FIG. 7, a passage 24 leads from each of the horizontal passages 20 to the near vertical passage 23; and from each vertical passage 23 two bolt holes 25 extend to the near end of the beam 13, one above and one below the semi-circular recess 22.

At each end of the floor section 11 is an integrally cast transverse beam 26, of lesser depth than the beams 13 of the roof section 10. Between the end beams 26 the floor section is of corrugated form, with two downwardly extending longitudinal channels 27 with oblique ends, the interiors of these channels being floor ducts 28. Except for these ducts, the floor section 11 has a flush upper surface. Weakened "knock-out" sections, indicated in broken outline at 29, are formed in the oblique ends of the channels 27, so that, if desired, passages may be easily formed at these positions.

Vertical passages 30 are formed through the end parts of each floor section beam 26, being aligned directly below the vertical passages 23 through the roof section beams 13. From each of the vertical passages 30, a bolt hole 31 leads to the near end of the beam 26.

Each of the rectangular-section columns 12 rigidly interconnects the central parts of a roof section beam 13 and a floor section beam 26. The columns may be secured to the beams in any suitable way; for example vertical rods (not shown) may be cast in the column, having exposed threaded ends which are passed through appropriate holes in the beams and engaged by nuts (not shown) countersunk in the beams.

Figure 6:
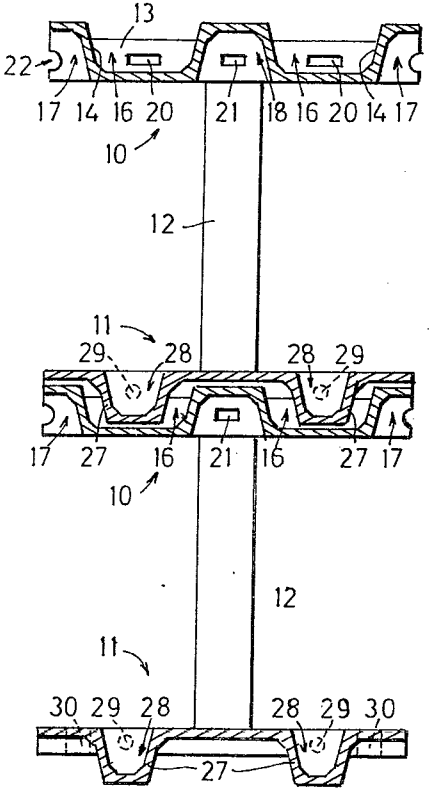
FIG. 6 is a cross-section of the assembly shown in FIG. 5.
Figure 5:
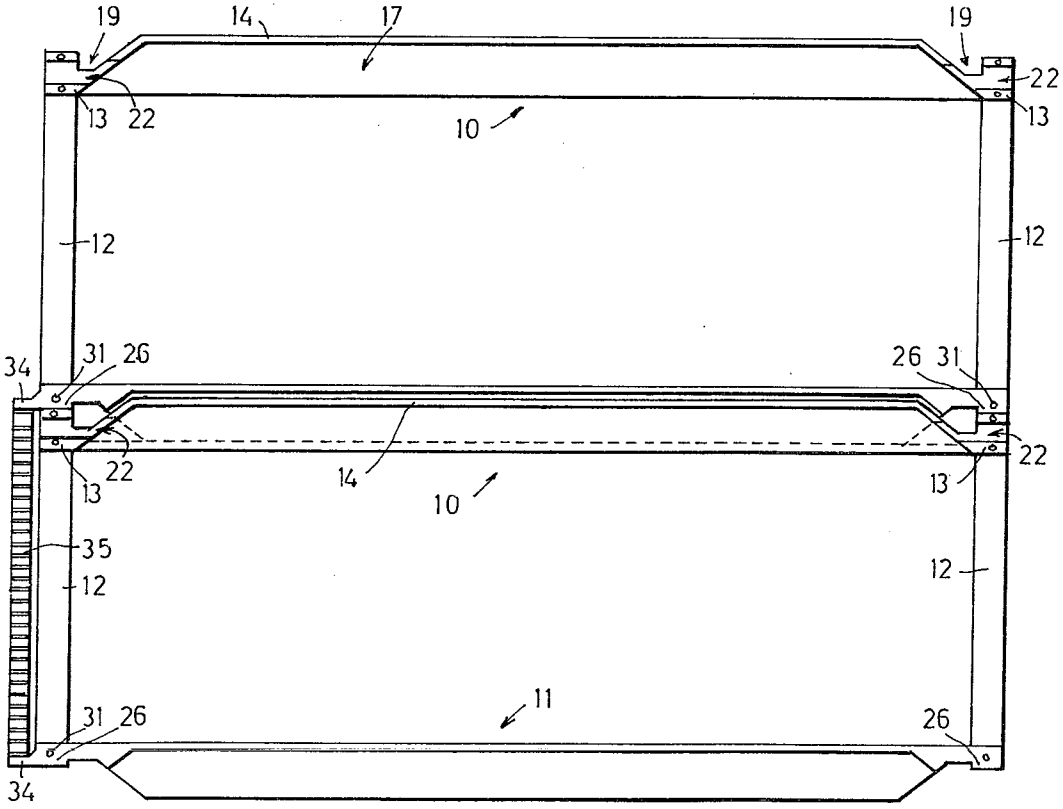
FIG. 5 shows in side elevation two modified units superimposed, and with part of an added wall.

A number of the building units may be assembled to form the main structure of a house, block of offices or other building, being interconnected in superimposed arrangement, and/or adjacently, and/or end to end. As shown in FIGS. 5 and 6, when units are superimposed, the floor section beams 26 of the upper unit bear on the roof section beams 13 of the lower unit. The downwardly extending floor section channels 27 of the upper unit fit into the roof section channels 16 of the lower unit, but with clearance between the two. A flow of heated air may be circulated under pressure between the superimposed units, for radiant heating, or insulation may be inserted.

As shown in FIG. 7, two units are interconnected adjacently by fitting a cylindrical metal tube 32 closely in the aligned semi-circular recesses 22 of each pair of adjacent roof beams 13, tension rods 33 through the aligned bolt holes 25 being engaged at their ends by nuts. Adjacent floor beams 26 are likewise bolted together by tension rods (not shown) through the aligned bolt holes 31.

The floor ducts 28 are closed by suitable flooring panels (not shown) removably fitted and secured in place; and any suitable ceiling panels (not shown) are used to close the roof ducts. It will be apparent that when two units are arranged adjacently, two half roof ducts 17 of the two units form a single roof duct.

In an assembly of units including two or more arranged end to end, these may be firmly secured by post-tensioning, tension cables (not shown) being carried through horizontally aligned passages, such as the central passages 21 of the roof beams 13, and tensioned. Post-tensioning may also be done through vertically aligned passages of superimposed units.

The end of a unit which forms part of the outer wall of a building may be modified, as shown in FIG. 5, by the provision of a ledge 34 extending outwardly from the floor beam 26 and capable of supporting a wall 35 of bricks, or other exterior cladding.

Figure 8:
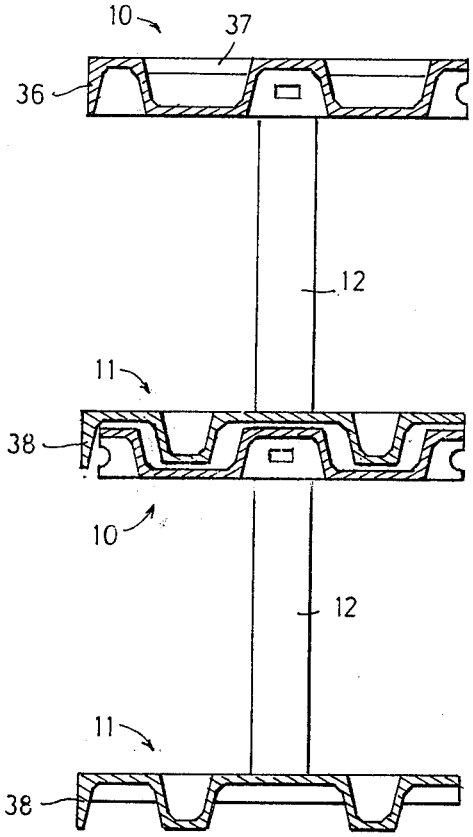
FIG. 8 is a cross-sectional view of two superimposed units of modified form.

The side of a unit at an outer wall of a building may be modified as shown in FIG. 8, to which reference is now made. The two superimposed units shown in this drawing are generally similar to those before described. However, at one side the upper unit is formed with a side piece or flange 36 extending downwardly from the top of the roof section rib 14, this side flange extending from end to end of the unit, and joining a front bead 37 extending upwardly from the front roof section beam 13. At the same side, the floor section 11 of the upper unit has a side flange 38 extending downwardly therefrom, from end to end. In the lower unit, the roof section 10 is as before described with reference to FIGS. 1 to 7, but the floor section 11 has a side flange 38 similar to that of the upper unit floor section.

The corrugated construction of the roof and floor sections of each unit give considerable strength in the longitudinal span between the sturdy beams at the end of the units, and the thickness of the corrugated sections may be minimal, and the weight of the unit relatively low. The single supporting column at each end of the unit enables great flexibility in design of buildings constructed from such units. The roof and floor sections may be cast so that the undersurfaces of the roof section and upper surfaces of the floor section are "off-mould" with dimensional accuracy. Moreover, the ducting system of the units is very extensive. The longitudinal roof ducts 17 and 18 usable, for example, for lighting, music, electric power and air conditioning, communicate, by passages 21 and 22 with the transverse ducts 19. The floor ducts 28, which may be used, for example, for water, gas telephone cables, sullage and electric power, may communicate through passages made by opening the "knock-out" sections 29, with the transverse ducts 19. The transverse ducts 19, in turn, communicate, through passages 20 and 24, with vertical passages 23 in the roof beams 13, and service lines and conduits may be carried down these passages 23 and the vertically aligned passages 30 of the floor beams 26.

Building units according to the invention will be found to be very effective in achieving the objects for which they have been devised. It will, of course, be understood that the particular embodiments of the invention herein described and illustrated may be subject to many modifications of constructional detail and design, which will be readily apparent to persons skilled in the art, without departing from the scope of the invention hereinafter claimed.

I claim:

1. A building unit including:

a. a substantially rectangular roof section shaped to form longitudinal corrugations between transverse beams at its ends, said transverse beams being intergrally formed with said longitudinal corrugations, said corrugations comprising upwardly extending hollow longitudinal ribs defining channels between them, b. a substantially rectangular floor section shaped to form longitudinal corrugations between transverse beams at its ends, said transverse beams being integrally formed with said longitudinal corrugations, said corrugations defining downwardly extending channels, and c. supporting means rigidly interconnecting the roof section and the floor section in spaced substantially parallel arrangement, said supporting means comprising a pair of columns each connected at its ends only to the middle parts of said transverse beams of said roof and floor sections, the parts being so made and arranged that when the unit is superimposed on a similar unit the floor section beams of the upper unit bear on the roof section beams of the lower unit and the floor section channels of the upper unit extend into the roof section channels of the lower unit.

2. A building unit including:

a. a substantially rectangular roof section shaped to form longitudinal corrugations between transverse beams at its ends, said transverse beams being integrally formed with said longitudinal corrugations, said corrugations of the roof section including upwardly extending hollow longitudinal ribs defining channels between them, the interiors of the ribs of the roof section constituting longitudinal roof ducts, a transverse duct formed between each roof section beam and the nearer ends of the said ribs, and passages from the longitudinal roof ducts to both transverse ducts, b. a substantially rectangular floor section shaped to form longitudinal corrugations between transverse beams at its ends, said transverse beam being integrally formed with said longitudinal corrugations, the corrugations of the floor section including downwardly extending channels, and c. supporting means rigidly interconnecting the roof section and the floor section in spaced substantially parallel arrangement, the parts being so made and arranged that when the unit is superimposed on a similar unit the floor section beams of the upper unit bear on the roof section beams of the lower unit and the floor section channels of the upper unit extend into the roof section channels of the lower unit.

3. A building unit according to claim 2 wherein passages are formed substantially horizontal through both roof section beams to the transverse ducts and to the roof ducts, passages are formed substantially horizontally through both roof section beams to the transverse ducts and to the roof ducts, passages are formed substantially horizontally through both roof section beams to the transverse ducts and to the channels between the ribs of the roof section, vertical passages are formed through the end portions of the roof section beams, and vertical passages are formed through the floor section beams in alignment with said vertical passages through the roof section beams.

* * * * *